US007467986B2

(12) United States Patent
Hanamoto et al.

(10) Patent No.: US 7,467,986 B2
(45) Date of Patent: Dec. 23, 2008

(54) TRANSFORMABLE TOY

(75) Inventors: Shinichi Hanamoto, Tokyo (JP); Koji Okamoto, Kanagawa (JP); Ryosuke Toriyama, Kanagawa (JP); Shinya Saito, Kyoto (JP); Motokazu Shibasaki, Tokyo (JP); Hachitaro Sato, Tokyo (JP)

(73) Assignee: Konami Digital Entertainment Co., Ltd., Tokyo (JP)

( * ) Notice: Subject to any disclaimer, the term of this patent is extended or adjusted under 35 U.S.C. 154(b) by 362 days.

(21) Appl. No.: 10/596,631

(22) PCT Filed: Dec. 17, 2004

(86) PCT No.: PCT/JP2004/018954

§ 371 (c)(1),
(2), (4) Date: Jun. 19, 2006

(87) PCT Pub. No.: WO2005/058446

PCT Pub. Date: Jun. 30, 2005

(65) Prior Publication Data

US 2007/0155276 A1 Jul. 5, 2007

(30) Foreign Application Priority Data

Dec. 19, 2003 (JP) ..... 2003-423890

(51) Int. Cl.
*A63H 3/46* (2006.01)

(52) U.S. Cl. ..... 446/383; 446/320; 446/376

(58) Field of Classification Search ..... 446/320, 446/330, 331, 376, 383, 487
See application file for complete search history.

(56) References Cited

U.S. PATENT DOCUMENTS

| | | | | |
|---|---|---|---|---|
| 4,411,097 | A * | 10/1983 | Murakami | 446/376 |
| 4,516,948 | A * | 5/1985 | Obara | 446/95 |
| 4,571,203 | A | 2/1986 | Murakami | |
| 6,089,950 | A * | 7/2000 | Lee et al. | 446/376 |
| 6,375,536 | B1 * | 4/2002 | Yang | 446/353 |
| 6,482,068 | B2 * | 11/2002 | Lee et al. | 446/376 |
| 6,491,567 | B2 * | 12/2002 | Chan | 446/478 |
| 6,568,984 | B1 * | 5/2003 | Applewhite | 446/176 |
| 6,679,749 | B2 * | 1/2004 | Yu | 446/71 |
| 6,805,606 | B1 * | 10/2004 | Kellum | 446/176 |

FOREIGN PATENT DOCUMENTS

| | | |
|---|---|---|
| JP | 63-311985 | 12/1988 |
| JP | 07-250972 | 10/1995 |
| JP | 2000-262765 | 9/2000 |

* cited by examiner

*Primary Examiner*—John Ricci
(74) *Attorney, Agent, or Firm*—Rankin, Hill & Clark LLP

(57) ABSTRACT

The present invention provides a transformable toy capable of transformations which are more unpredictable than those according to the prior art. A neck section (19) is constructed to be extended and contracted in a direction where a first to fourth components (35-41) are arranged. The first component (35) is fixed to a fixed section of the transformable toy. The first component (35) and the second component (37) are connected by a slide type connecting mechanism. The second component (37) is fitted in the first component (35). The second to fourth components (37-41) are connected by a rotary type connecting mechanism. All or most of the second to fourth components (37-41) are received in the first component (35).

9 Claims, 10 Drawing Sheets

TRANSFORMABLE TOY

TECHNICAL FIELD

The present invention relates to a transformable toy provided with an extension and contraction structure, which comprises a plurality of components connected in order via connecting mechanisms. The extension and contraction structure of this invention extends and contracts in a direction where the plurality of components are arranged.

BACKGROUND ART

As shown in Japanese Patent Laid-open Publication No. H05-82233 (Patent Document 1), Patent No. 2899783 (Patent Document 2), the conventional transformable toys have employed an extension and contraction structure for connecting two component units with a simple sliding mechanism.

[Patent Document 1] Japanese Patent Laid-open Publication No. H05-82233

[Patent Document 2] Patent No. 2899783

DISCLOSURE OF THE INVENTION

Problems to be Solved by the Invention

Conventional extension and contraction structures can only produce transformations of just extending and contracting linearly. Such transformations give the user a very simple impression without any unpredictable nature of transformations.

An object of the present invention is to provide a transformable toy capable of transformations which are more unpredictable than those according to the prior art.

Another object of the present invention is to provide a transformable toy capable of transformations based not only on extension and contraction but also on bending.

Means of Solving the Problems

The present invention is directed to a transformable toy provided with an extension and contraction structure capable of extending and contracting, which comprises a plurality of components connected via connecting mechanisms.

The extension and contraction structure includes a first to nth (n is a positive integer of 3 or more) components which are connected in order via a first to n−1th connecting mechanisms respectively, and is constructed to extend and contract in a direction where the first to nth components are arranged. The first component is fixed to a fixed portion of the transformable toy. A slide type connecting mechanism, which connects the first component and the second component so that the first and second components can slide in the direction where the components are arranged, is used as the first connecting mechanism that connects the first component and the second component. The second component is adapted to be fitted in the first component. With this arrangement, the slide type connecting mechanism is constructed in such a manner that the second component may slide with respect to the first component between a first position where the second component is entered most deeply inside the first component and a second position where the second component is entered least deeply inside the first component. One or more of the second to n−1th connecting mechanisms except the first connecting mechanism is a rotary type connecting mechanism that connects two adjoining components in such a manner that the two adjoining components can rotate or tilt with respect to each other in a predetermined angular range. The first to nth components are constructed in such a manner that all or most of the third to nth components may be received inside the first component when the second component is located in the first position.

The extension and contraction structure of the present invention is capable of obtaining a large amount of extension and contraction by pulling out the second component up to the second position. This allows the user to feel an unpredictable nature of transformation when the pulled-out second to nth components can be seen. Moreover, the structure of the second to nth components can attain slight extending and contracting transformation and bending since rotation or tilting in a predetermined angular range is obtained between two adjoining components connected by the rotary type connecting mechanism. As a result, the user can recognize much more unpredictable transformations than ever and enjoy such transformations much more than ever.

Preferably, the transformable toy of the present invention further comprises an engaging portion and an engaged portion that are engaged when the second component is located in the first or second position, and are disengaged when the second component is located in the first or second position and is positively applied a force to cause a slide movement between the first component and the second component. Preferably, one of the engaging portion and the engaged portion is provided to the first component and the other is provided to the second component. With this arrangement, the second component does not slide merely by inclining or tilting the transformable toy, and the transformed configuration of the extension and contraction structure can be kept more reliably.

The rotary type connecting mechanism comprises a rotating shaft provided to one of the two components which are connected to each other by the rotary type connecting mechanism, and extending in a direction which crosses (preferably, orthogonal to) the direction where the plurality of components are arranged, a connected portion provided to the other of the two components, and rotatably connected to the rotating shaft, and a stopper which defines a rotation range of the other component rotating around the rotating shaft. When the rotary type connecting mechanism is used, the two components are rotated or tilted in a predetermined angular range around the rotating shaft. Since rotational/tilting operation is limited by the stopper, application of a force, which is strong enough to destroy the connecting mechanism, to each component can be prevented.

All of the second to n−1th connecting mechanisms connecting the second to nth components in order may comprise the rotary type connecting mechanisms. With this arrangement, the second to nth components pulled out from the first component can be bent most greatly. As a result, transformation into a long neck, a long body, or a long tail can be attained easily.

The rotating shafts of the second to n−1th connecting mechanisms (the number of shafts is n−2) are arranged in a row along a hypothetical center line extending through the center of a row of the components arranged therein and in a direction where the components are arranged. The stoppers of the second to n−1th connecting mechanisms, located in n−2 positions, are arranged along the hypothetical center line and opposite to the rotating shafts with respect to the hypothetical center line. With this arrangement, the hypothetical center line can always curve in the shape of an arch or an arc, and the extension and contraction structure, which can easily form a long-necked doll toy such as a long-necked dinosaur and a long-necked monster, can be acquired.

When the components used are first to fourth components, the extension and contraction structure can be constructed as follows. The second component includes a first fitted hole that is surrounded by a peripheral wall and is opening toward one direction, and a first connected portion disposed further than the first fitted hole in the one direction. The third component includes a first fitting portion loosely fitted in the first fitted hole, a first rotating shaft to which the first connected portion is connected, a second fitted hole that is surrounded by a peripheral wall and is opening toward the one direction, a second connected portion disposed further than the second fitted hole in the one direction. The fourth component includes a second fitting portion fitted loosely in the second fitted hole, and the second rotating shaft to which the second connected portion is connected. With this arrangement, the second to fourth components can be connected easily only by making connections between the rotating shafts and the connected portions. In this case, one stopper is constituted by a part of an inner wall portion of the first fitted hole and a part of an outer wall portion of the first fitting portion that contacts the part of the inner wall portion of the first fitted hole, and another stopper is constituted by a part of an inner wall portion of the second fitted hole and a part of an outer wall portion of the second fitting portion that contacts the part of the inner wall portion of the second fitted hole. Thus, the stoppers can be constituted without providing any special configuration for the stopper. In addition, manufacturing thereof becomes easy.

The extension and contraction structure of the present invention may be used for any part of the transformable toy which can change its appearance by transforming a part of the body. In the case of a long-necked toy doll, what is necessary is just to apply the extension and contraction structure of the present invention to the neck section. In the case of a long-tailed toy doll, what is necessary is just to apply the extension and contraction structure of the present invention to the formation of the tail. The extension and contraction structure of the present invention can further be used for an arm section and a leg section.

BEST MODE FOR CARRYING OUT THE INVENTION

Figure 1:
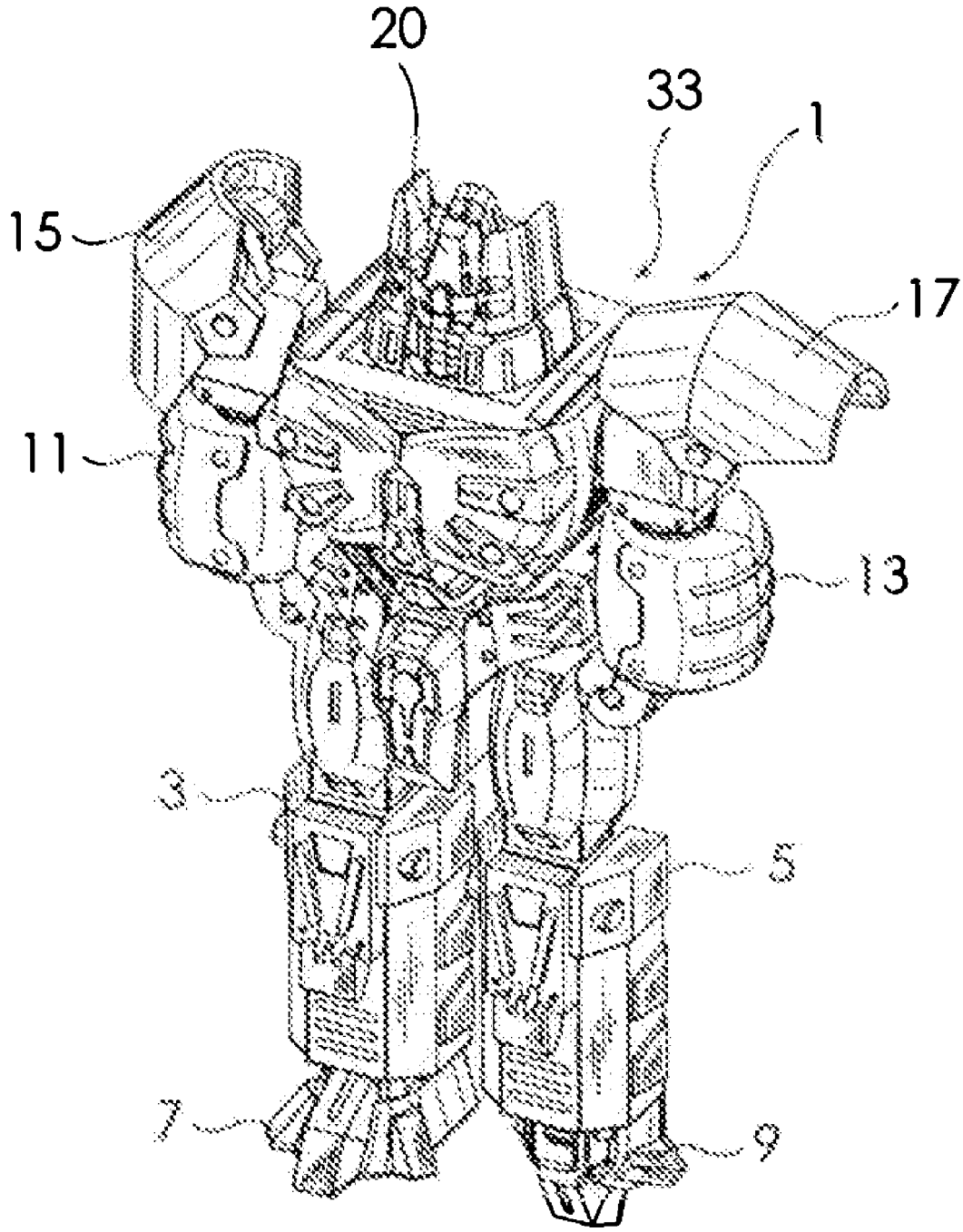
FIG. 1 is a perspective view showing a transformed figure of a transformable toy according to an embodiment of the present invention.
Figure 2:
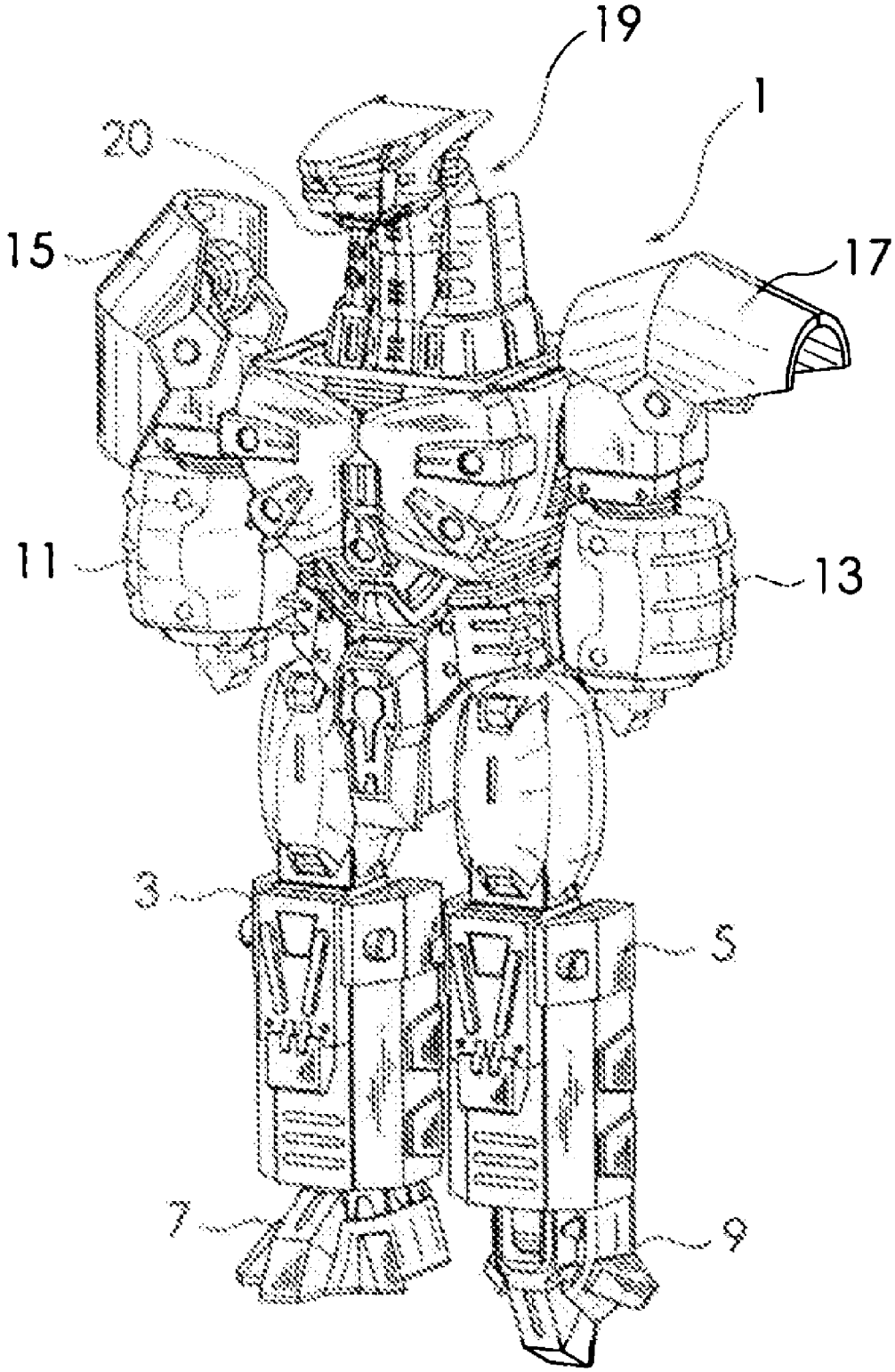
FIG. 2 is a perspective view showing a transformed figure of a transformable toy according to the embodiment of the present invention.
Figure 3:
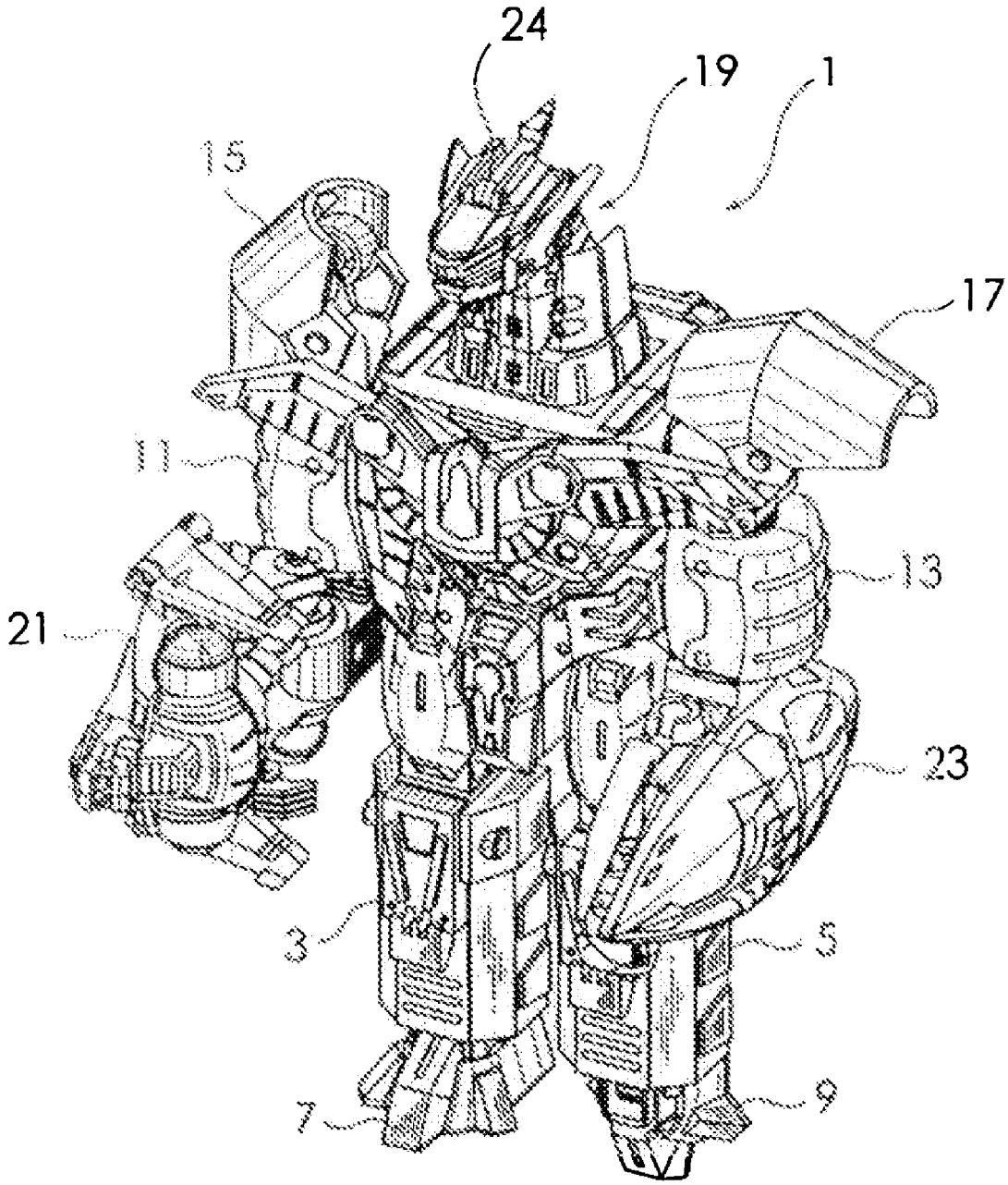
FIG. 3 is a perspective view showing a transformed figure of a transformable toy according to the embodiment of the present invention.
Figure 4:
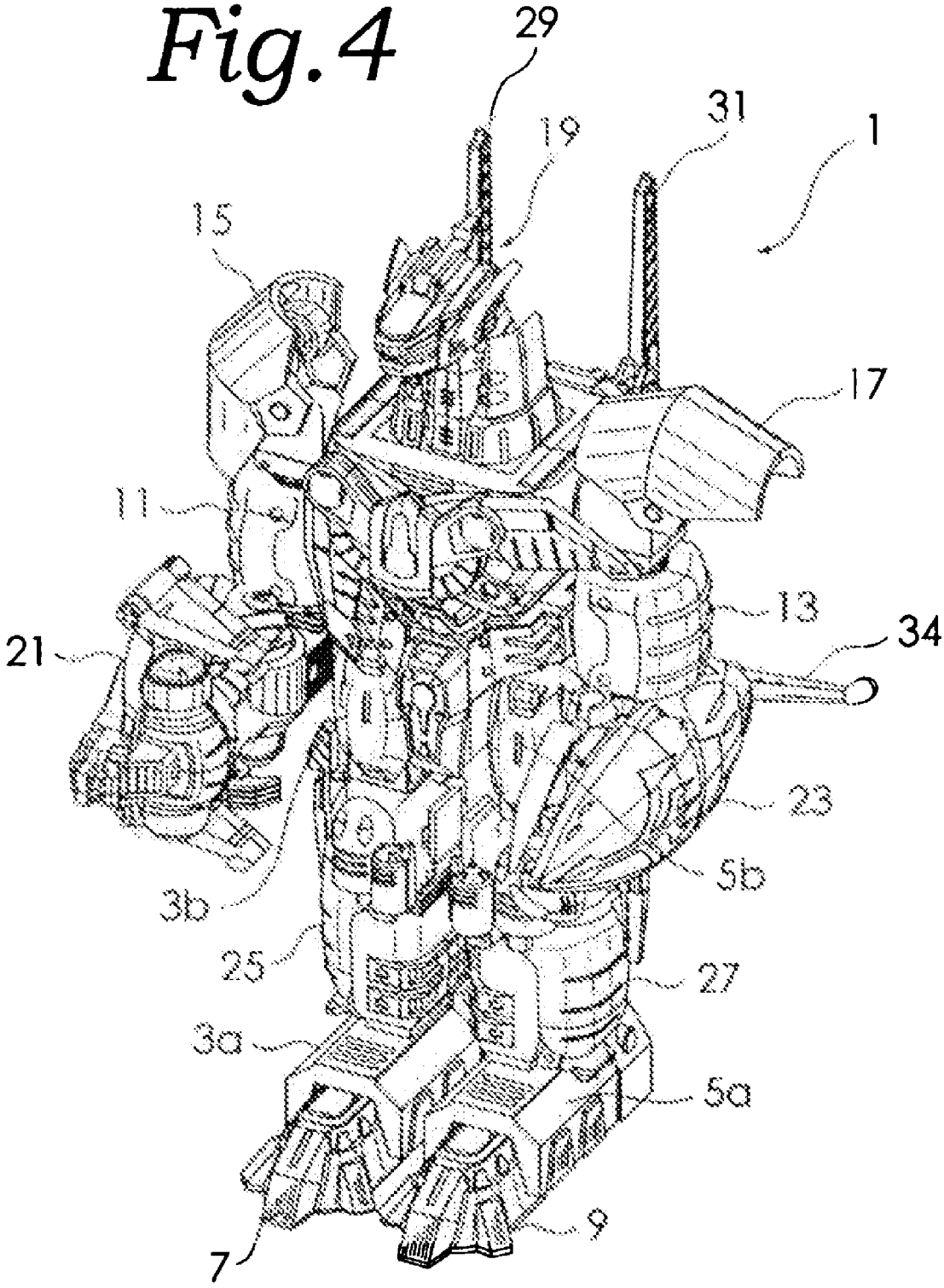
FIG. 4 is a perspective view showing a transformed figure of a transformable toy according to the embodiment of the present invention.

A preferred embodiment of the present invention will now be described in detail with reference to the accompanying drawings. FIGS. 1 to 4 are perspective views respectively showing a transformed figure of a transformable toy according to the embodiment of the present invention. The transformable toy is what is called a toy robot. In FIG. 1, a left foot section 9, which is one of foot sections 7 and 9 provided at the ends of two leg sections 3 and 5 of a toy robot 1, is transformed into a state of standing on tiptoe. A covering 15 on the right side shoulder, which is one of coverings 15 and 17 for covering shoulders located upon two arm sections 11 and 13, is transformed into a state of standing upright. In FIG. 2, the figure is changed in such a manner that a neck section 19 is extended and a head section 20 is inclined ahead, as is known in comparison with FIG. 1. In order to extend and contract the neck section 19, an extension and contraction structure for a transformable toy, which will be explained in detail later, is employed. The figure shown in FIG. 3 is different from that of FIG. 2 in that components 21, 23 are connected via connecting mechanisms respectively to components which constitute arm sections 11, 13 and that a component 24 is connected to the head section 20 via a connecting mechanism, as is known by comparing FIG. 3 with FIG. 2. The figure shown in FIG. 4 is different from that of FIG. 3 in that the configuration of the leg sections is different, a tail is attached, and a weapon is carried on the back of the toy robot, as is known by comparing FIG. 4 with FIG. 3. In FIG. 4, the leg sections 3, 5 shown in FIG. 3 are separated into two parts of thigh sections 3*b*, 5*b* and shin sections 3*a* and 5*a* respectively, and components 25, 27 are connected to thigh sections 3*b*, 5*b* via connecting mechanisms while the original shin sections 3*a*, 5*a* and the parts below the shin section 3*a*, 5*a* are connected to below the components 25, 27. The foot sections 7, 9 are transformed into a state of standing on tiptoe with respect to the shin sections 3*a*, 5*a*. In FIG. 4, since the configuration of the feet becomes large compared with that of FIG. 3, the standing condition of the toy robot will be more stable.

Figure 5:
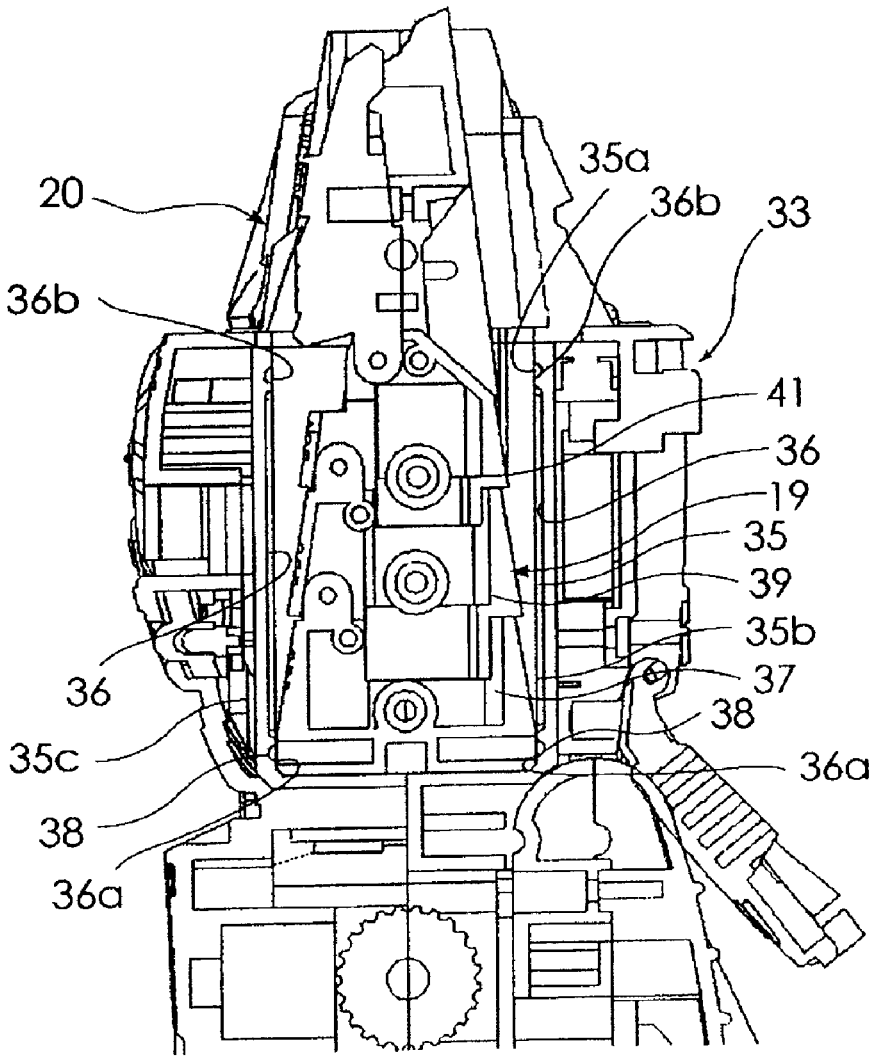
FIG. 5 is an imaginary illustration showing an extension and contraction structure which constitutes a neck section of the transformable toy of FIG. 1 to FIG. 4.
Figure 6:
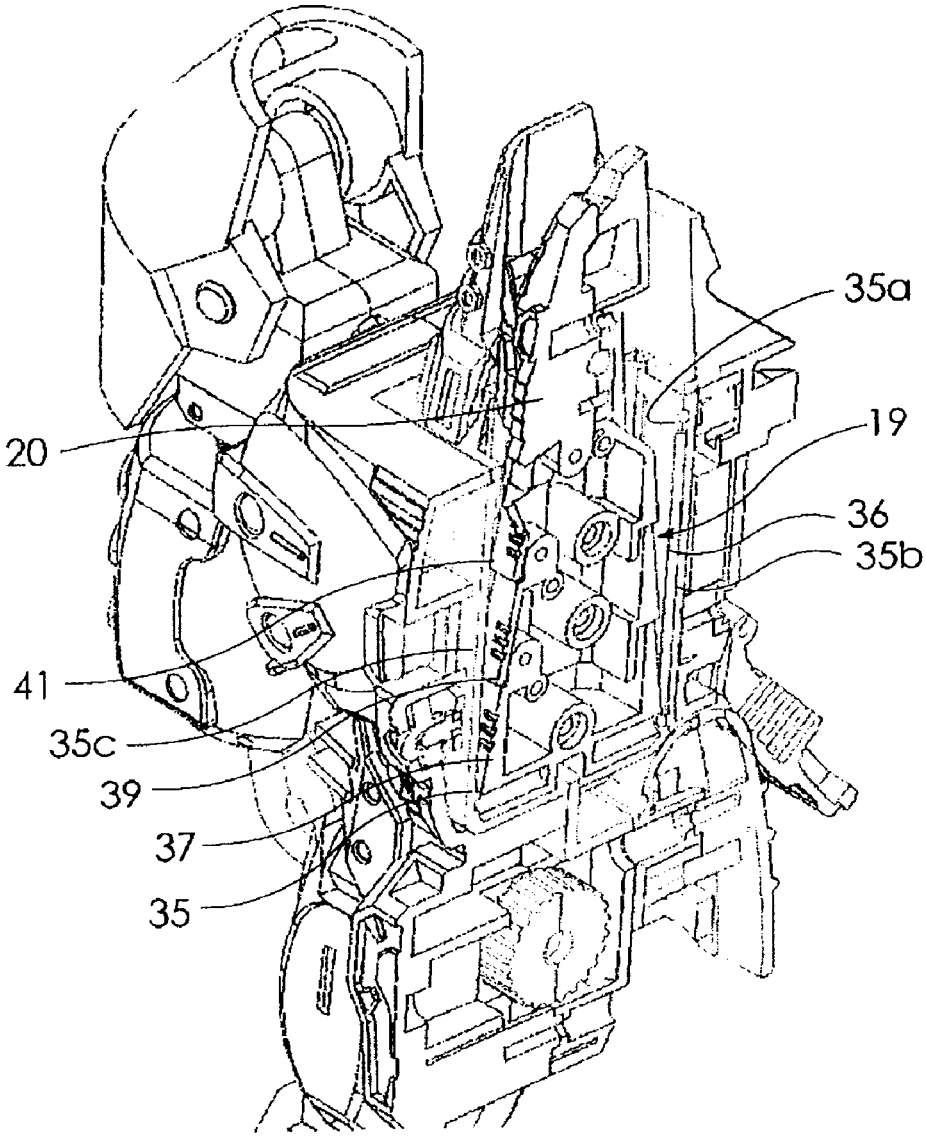
FIG. 6 is an imaginary illustration showing the extension and contraction structure which constitutes the neck section of the transformable toy of FIG. 1 to FIG. 4.
Figure 7:
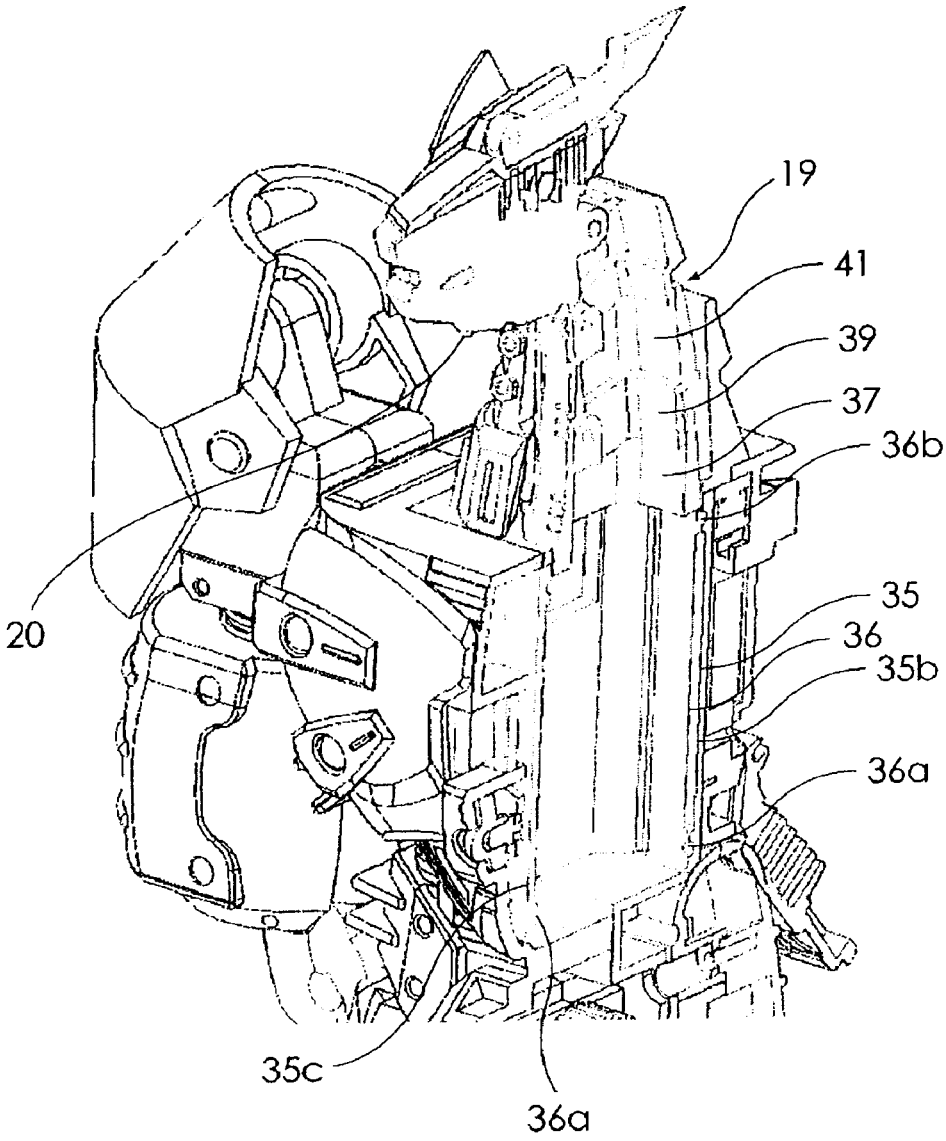
FIG. 7 is an imaginary illustration showing the extension and contraction structure which constitutes the neck section of the transformable toy of FIG. 1 to FIG. 4.
Figure 8:
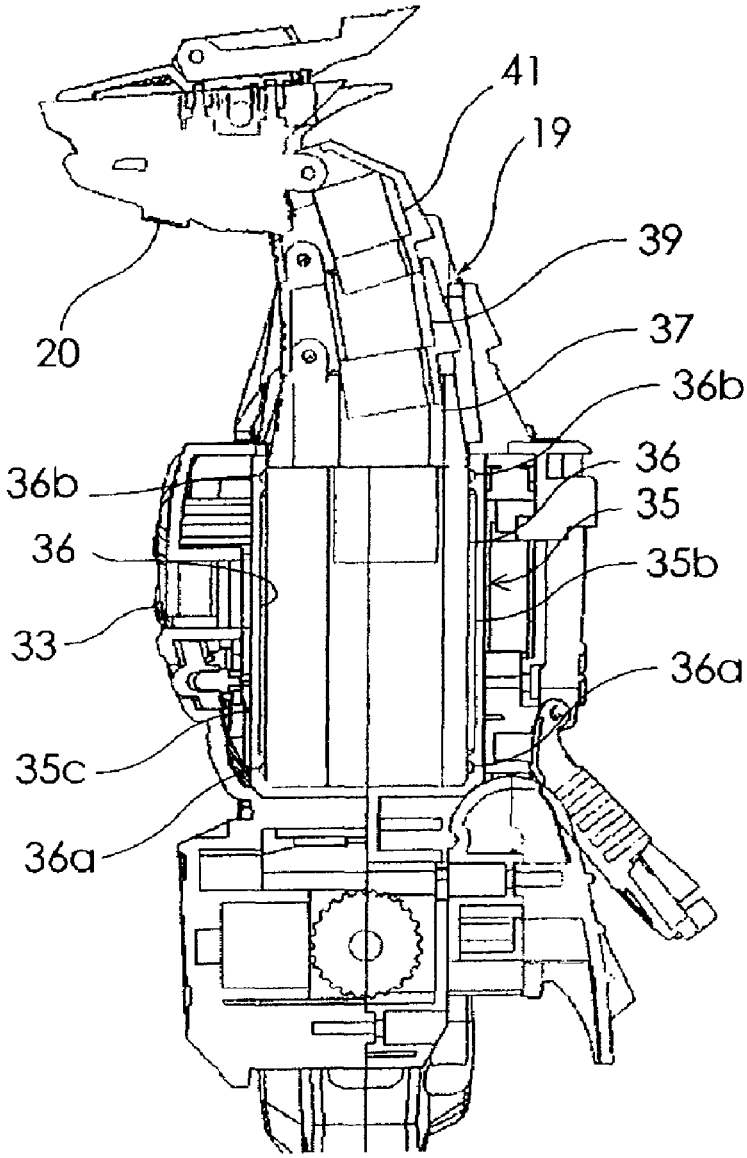
FIG. 8 is an imaginary illustration showing the extension and contraction structure which constitutes the neck section of the transformable toy of FIG. 1 to FIG. 4.

FIGS. 5 to 8 are imaginary illustrations respectively showing the extension and contraction structure which constitutes the neck section 19 of the toy robot 1 shown in FIGS. 1 to 4. FIGS. 9A to 9E are views used to explain a construction of the neck section 19. FIGS. 5 and 6 are longitudinal sectional views showing an inner construction of an upper-half body 33 of the toy robot before transformation in which the neck section 19 is not extended yet and the head section 20 is located upon the upper-half body 33 as shown in FIG. 1. FIGS. 7 and 8 are longitudinal sectional views showing a half part of the construction in which the neck section 19 is extended and the main part of the neck section is exposed to the exterior of the upper-half body 33.

Figure 9A:
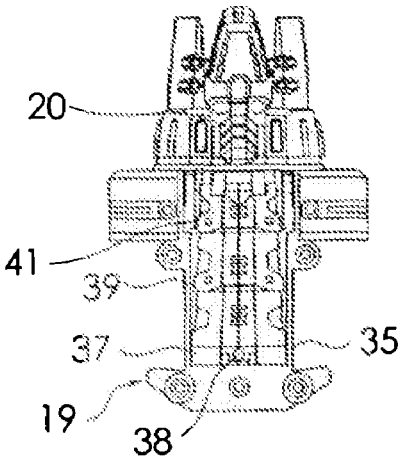
FIG. 9A is a partial cross sectional view used to explain the construction of the neck section including the first to fourth components.
Figure 9B:
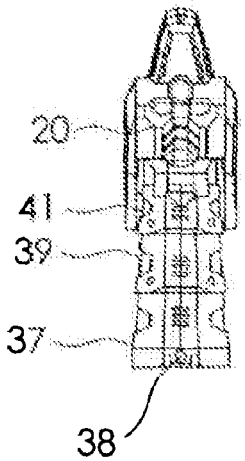
FIG. 9B is a front elevation view showing the main part of the construction for the neck section including the second to fourth components.
Figure 9C:
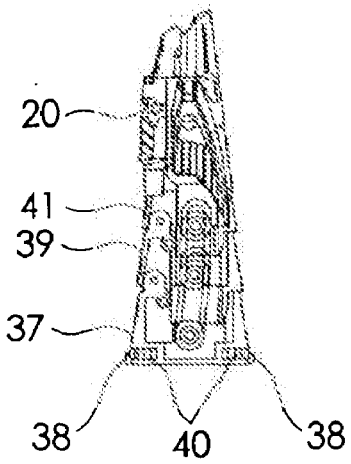
FIG. 9C is a longitudinal sectional view showing the half part of FIG. 9B.
Figure 9D:
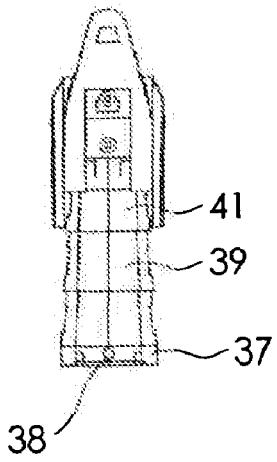
FIG. 9D is a back elevation view showing the main part of the neck section of FIG. 9B.
Figure 9E:
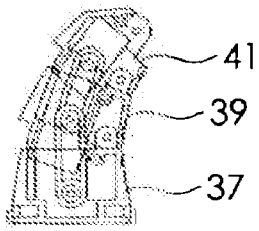
FIG. 9E is a view showing how the main part of the neck section is bent.

Inside the upper-half body of the toy robot 1, first to fourth components 35, 37, 39, 41 constituting the extension and contraction structure of the neck section 19 are received. The first to fourth components (5-41 are connected in order via first to third connecting mechanisms respectively. The first component 35 is fixed to the inner part of the upper-half body 33 (fixed section) of the toy robot 1. The first component 35 is shaped in a box having an opening 35*a* in the upper part thereof. As well shown in FIG. 5, a pair of side wall portions 35*b* and 35*c* of the first component 35 are formed with a pair of guide grooves 36, 36, which are opening inwardly and extending in a longitudinal direction. At the lower and upper ends of each of the paired guide grooves 36, engagement recesses or engaged portions 36*a*, 36*b* are provided respectively in such a manner that the engaged portions are not discontinuous with the guide grooves 36. A pair of rolling ball members 38 (shown in FIGS. 5 and 9) provided in the second component 37 are fitted in these pairs of guide grooves 36 and engaged portions 36*a*, 36*b*. As shown in FIG. 9C, the rolling balls 38 are always biased outwardly by compression springs 40. For example, if the second to fourth components 37-41 are pulled up when the rolling balls 38 are fitted in the lower engaged portions 36*a*, the rolling balls 38 will clime over the wall portions which are provided between the engaged portions 36*a* and the guide grooves 36 and then enter into the guide grooves 36. If the second to fourth components 37-41 are further pulled up in this condition, the rolling balls 38 will also go up along the guide grooves 36, and will eventually fit into the upper engaged portions 36*b*. As a result, the second to fourth components 37-41 are prevented from falling down by gravitation. If a force of going downward is applied to the second to fourth components 37-41 in this condition, the rolling balls 38 will climb over the wall portions between the engaged portions 36*b* and the guide grooves 36, and enter into the guide groove 36, and then move further downward. If the components 37-41 are finally pushed down strongly, the rolling balls 38 will enter into the engaged portions 36*a*, 36*a*, thereby preventing the components from moving upward. According to the present embodiment, a first connecting mechanism that connects the first component and the second component is constituted by the guide grooves 36, 36, the lower and upper engaged portions 36*a* and 36*b* and the rolling balls 38. This connecting mechanism is a slide type connecting mechanism which connects the first component 35 and the second component 37 so that the first and second components can slide in a direction where the components 35-41 are arranged. The slide type connecting mechanism is constructed in such a manner that the second component 37 may slide with respect to the first component 35 between a first position where the second component 37 is entered most deeply inside the first component 35 (in the first position the rolling balls 38 are entered into the lower engaged portions 36*a* as shown in FIGS. 5 and 6) and a second position where the second component 37 is entered least deeply inside the first component 35 (in the second position the rolling balls 38 are entered into the upper engaged portions 36*b* as shown in FIGS. 7 and 8). In this embodiment, all or most of the second to fourth components 37-41 are received in the first component 35 when the second component 37 is located in the first position. In this condition, therefore, the neck section 19 is unobservable from the outside.

A rotary type connecting mechanism, which is capable of connecting two adjoining components so that the two connected components can rotate or tilt with respect to each other within a predetermined angular range, is employed for a second connecting mechanism that connects the second component 37 and the third component 39, and for a third connecting mechanism that connects the third component 39 and the fourth component 41. This rotary type connecting mechanism will be explained below with reference to FIGS. 11A to 10C. The rotary type connecting mechanisms comprise rotating shaft 45*a*, 45*b*, connected portions 47*a*, 47*b*, and stoppers 49*a*, 49*b*, respectively. The rotating shafts 45*a*, 45*b* are respectively provided at one component 39, 41 of the two components 37 and 39, or 39 and 41 that are connected to each other by the rotary connecting mechanism and extend in a direction that crosses (preferably orthogonal to) the direction where the components are arranged. The connected portions 47*a*, 47*b* are provided at the other 37, 39 of the two components 37 and 39, or 39 and 41, and rotatably connected 37, 39 to the rotating shafts 45. The stoppers 49*a*, 49*b* define the rotation ranges of the other components around the rotating shafts 45*a*, 45*b*. When such a rotary type connecting mechanism is used, the two components are rotated or tilted in a predetermined angular range around the rotating shafts 45*a*, 45*b*. The rotational or tilting movement is limited by the presence of the stoppers 49*a*, 49*b*.

More concretely, the second component 37 includes a first fitted hole 37*b* which is surrounded by a peripheral wall portion 37*a* and is opening toward one direction, and a first connected portion 47*a* located higher than the first fitted hole 37*b*. The first connected portion 47*a* has a through hole 47*a*1 through which the rotating shaft 45*a* fits in. The third component 39 includes a first fitting portion 39*a* to fit loosely in the first fitted hole 37*b* of the second component 37, the first rotating shaft 45*a* to which the first connected portion 47*a* is connected, a second fitted hole 39*b* which is surrounded by a peripheral wall portion 39*a* and is opening at least upwardly, and the second connected portion 47*b* located higher than the second fitted hole 39*b*. The second connected portion 47*b* has a through hole 47*b*1 through which the rotating shaft 45*b* fits in. The fourth component 41 includes a fitting portion 41*a* which loosely fits in the second fitted hole 39*b* of the third component 39, and the second rotating shaft 45*b* to which the second connected portion 47*b* of the third component 39 is connected.

With this arrangement, the second to fourth components 37-41 can be easily connected only by making connections between the rotating shafts 45*a*, 45*b* and the connected portions 47*a*, 47*b*, respectively. The stopper 49*a* is constituted by a part of an inner wall portion of the first fitted hole 37*b* and a part of an outer wall portion of the first fitting portion 39*a* that contacts the part of the inner wall portion of the first fitted hole. The stopper 49*b* is constituted by a part of an inner wall portion of the second fitted hole 39*b* and a part of an outer wall portion of the second fitting portion 41*a* that contacts the part of the inner wall portion of the second fitted hole. With this arrangement, the stoppers can be constituted without providing a special structure for the stopper. As a result, the construction of the extension and contraction structure becomes simpler, and what is more, the manufacturing process thereof becomes easy.

In this embodiment, all of the second and third connecting mechanisms that connect the second to fourth components in order are constructed by the rotary type connecting mechanisms. Therefore, it becomes possible to bend most greatly the second to fourth components 37-41 which are pulled out from the first component 35 (refer to FIG. 9E). As a result, a transformed long neck can be formed easily.

Figure 10A:
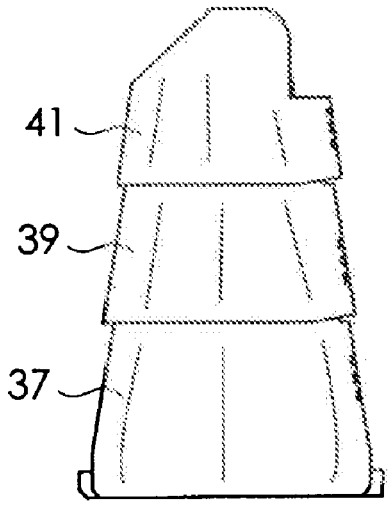
FIG. 10A is a side elevation view showing the main part of the neck section.
Figure 10B:
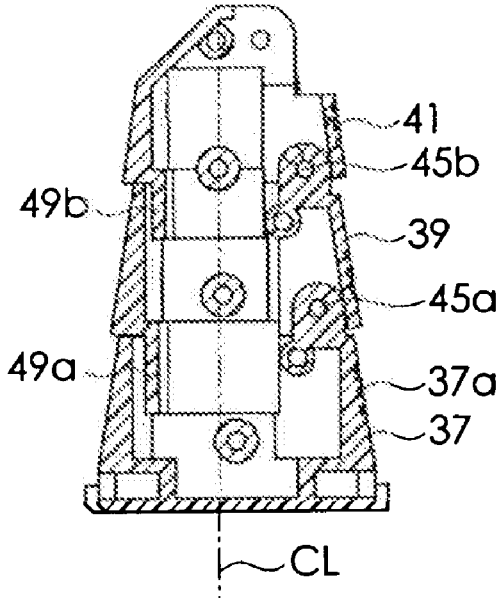
FIG. 10B is a view showing the internal structure of FIG. 10A.
Figure 10C:
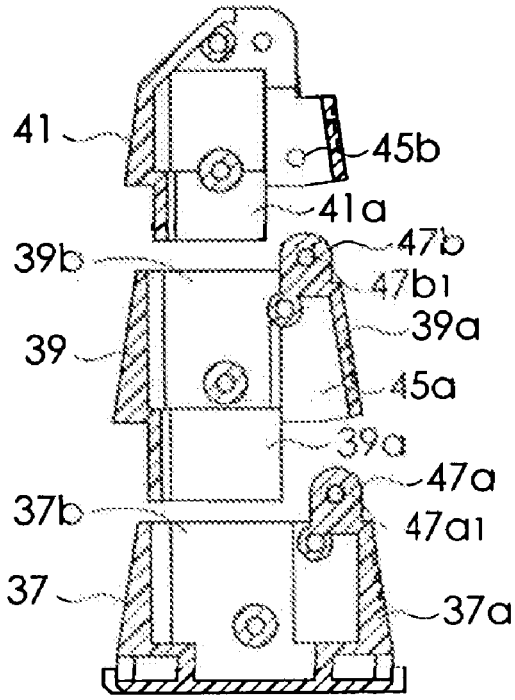
FIG. 10C is a vertically exploded view of FIG. 10B.

In this embodiment, as shown in FIG. 10B, the two rotating shafts 45*a*, 45*b* of the second and third connecting mechanisms are arranged side by side along a hypothetical center line CL extending through the center of a row of the first to fourth components 35-41 arranged therein, and in the direction where the components are arranged. The two stoppers 49*a*, 49*b* of the second and the third connecting mechanisms are arranged along the hypothetical center line CL and opposite to the rotating shafts 45*a*, 45*b* with respect of the hypothetical center line CL. With this arrangement, the hypothetical center line CL can always curve in the shape of an arch or an arc, and an extension and contraction structure, which can easily construct the neck section of a doll in to a long neck configuration, can be obtained.

According to the present embodiment, a large amount of extension and contraction can be obtained by pulling out the second component 37 to the second positions (in the second positions the rolling balls 38 are entered into the upper engaged portions 36*b* as shown in FIGS. 7, 8). The user can feel an unpredictable nature of transformation since the pulled-out second to fourth components 37-41 can be seen. Moreover, since rotation or tilting in a predetermined angular range between two components (between the components 37 and 39, or 39 and 41), which are connected by the rotary type connecting mechanisms, can be obtained, the connected portions of the second to fourth components 37-41 can obtain slight extending and contracting transformation and bending transformation. As a result, the user can feel much more unpredictable transformation than ever.

The above-mentioned extension and contraction structure may be used for any part of a transformable toy capable of changing its figure by transforming a part of its body. In the case of a toy doll with a long neck, what is necessary is just to apply the extension and contraction structure of the present invention to the neck section. In the case of a toy doll which has a long tail 34 as shown in FIG. 4, the above-mentioned extension and contraction structure is applicable to the formation of the tail 34. If the extension and contraction structure is applied to an arm or leg section, a more unpredictable transformation can be obtained.

INDUSTRIAL APPLICABILITY

The extension and contraction structure of the present invention has such advantages that a large amount of extension and contraction is obtainable by pulling out the second component up to the second position and that the user can feel an unpredictable nature of transformation due to the appearance of the pulled-out second to nth components. Moreover, rotation or tilting in a predetermined angular range is obtained between two components connected to each other by the rotary type connecting mechanism. Therefore, the connecting portions of the second to nth components can obtain slight extending and contracting transformation and bending transformation. As a result, the user can feel a more unpredictable nature of transformation than ever. In addition, the pleasure of transforming a toy can be increased much more.

The invention claim is:

1. A transformable toy provided with an extension and contraction structure capable of extending and contracting, comprising a plurality of components connected via connecting mechanisms, the extension and contraction structure including a first to nth (n is a positive integer of 3 or more) components which are connected in order via a first to n−1th connecting mechanisms respectively, and being constructed to extend and contract in a direction where the first to nth components are arranged;

the first component being fixed to a fixed section of the transformable toy;

the first connecting mechanism that connects the first component and the second component being a slide type connecting mechanism that connects the first component and the second component so that the first and second components can slide in the direction;

one or more of the second to n−1th connecting mechanisms except the first connecting mechanism being a rotary type connecting mechanism that connects two adjoining components in such a manner that the two adjoining components can rotate with respect to each other in a predetermined angular range;

the second component being fitted in the first component;

the slide type connecting mechanism being constructed in such a manner that the second component may slide with respect to the first component between a first position where the second component is entered most deeply inside the first component and a second position where the second component is entered least deeply inside the first component; and the first to nth components being constructed in such a manner that all or most of the third to nth components may be received inside the first component when the second component is located in the first position.

2. The transformable toy as defined in claim 1, further comprising an engaging portion and an engaged portion which are engaged when the second component is located in the first or second position, and are disengaged when the second component is located in the first or second position and is positively applied a force to cause a slide movement between the first component and the second component, one of the engaging portion and the engaged portion being provided to the first component and the other being provided to the second component.

3. The transformable toy as defined in claim 2, the rotary type connecting mechanism comprising:

a rotating shaft provided to one of the two components that are connected to each other by the rotary type connecting mechanism, and extending in a direction that crosses the direction where the components are arranged;

a connected portion provided to the other of the two components, and rotatably connected to the rotating shaft; and a stopper that defines a rotation range of the other component rotating around the rotating shaft.

4. The transformable toy as defined in claim 1, the rotary type connecting mechanism comprising:

a rotating shaft provided to one of the two components that are connected to each other by the rotary type connecting mechanism, and extending in a direction that crosses the direction where the components are arranged;

a connected portion provided to the other of the two components, and rotatably connected to the rotating shaft; and a stopper that defines a rotation range of the other component rotating around the rotating shaft.

5. The transformable toy as defined in claim 1, wherein all of the second to n−1th connecting mechanisms connecting the second to nth components in order are the rotary type connecting mechanisms.

6. The transformable toy as defined in claim 5, wherein the rotary type connecting mechanism used for each of the second to n−1th connecting mechanisms, comprising:

a rotating shaft provided to one of the two components that are connected to each other by the rotary type connecting mechanism, and extending in a direction that crosses the direction where the components are arranged;

a connected portion provided to the other of the two components, and rotatably connected to the rotating shaft; and a stopper that defines a rotation range of the other component rotating around the rotating shaft, wherein the rotating shafts of the second to n−1th connecting mechanisms, n−2 in number of the shafts, are arranged in a row along a hypothetical center line extending through the center of a row of the components arranged therein and in the direction where the components are arranged, and wherein the stoppers of the second to n−1th connecting mechanisms, located in n−2 positions, are arranged along the hypothetical center line and opposite to the rotating shafts with respect to the hypothetical center line.

7. The transformable toy as defined in claim 6, wherein the plurality of components are first to fourth components, the second component includes a first fitted hole surrounded by a peripheral wall and opening toward one direction, and a first connected portion disposed further than the first fitted hole in the one direction;

the third component includes a first fitting portion loosely fitted in the first fitted hole, a first rotating shaft to which the first connected portion is connected, a second fitted hole surrounded by a peripheral wall and opening toward the one direction, and a second connected portion disposed further than the second fitted hole in the one direction, and the fourth component includes a second fitting portion fitted loosely in the second fitted hole, and a second rotating shaft to which the second connected portion is connected.

8. The transformable toy as defined in claim 7, wherein one stopper is constituted by a part of an inner wall portion of the first fitted hole and a part of an outer wall portion of the first fitting portion that contacts the part of the inner wall portion of the first fitted hole, and another stopper is constituted by a part of an inner wall portion of the second fitted hole and a part of an outer wall portion of the second fitting portion that contacts the part of the inner wall portion of the second fitted hole.

9. The transformable toy as defined in claim 1, wherein a neck section, an arm section, a leg section, or a tail section of the transformable toy is used as the extension and contraction structure.

* * * * *